US005501578A

United States Patent [19]

Skirde

[11] Patent Number: 5,501,578

[45] Date of Patent: Mar. 26, 1996

[54] HYDROSTATIC AXIAL PISTON PUMP WITH THREE BEARING ARRANGEMENT

[75] Inventor: Eckhard Skirde, Aukrug-Boken, Germany

[73] Assignee: Sauer Inc., Ames, Iowa

[21] Appl. No.: 383,296

[22] Filed: Feb. 3, 1995

Related U.S. Application Data

[63] Continuation of Ser. No. 104,887, Aug. 10, 1993, abandoned.

[30] Foreign Application Priority Data

Aug. 14, 1992 [DE] Germany ..... 42 27 037.5

[51] Int. Cl.[6] ..... F04B 23/10

[52] U.S. Cl. ..... 417/199.1; 417/206

[58] Field of Search ..... 417/199.1, 205, 417/201, 203, 206, 269, 426; 92/12.1, 12.2, 71; 60/488

[56] References Cited

U.S. PATENT DOCUMENTS

| | | | |
|---|---|---|---|
| 2,604,047 | 7/1952 | Beaman et al. | 417/206 |
| 2,715,875 | 8/1955 | Towler et al. | 417/206 |
| 3,213,616 | 10/1965 | Reinke | 60/488 |
| 3,698,286 | 10/1972 | Ellis et al. | 417/201 |
| 4,014,628 | 3/1977 | Ruseff et al. | 417/203 |

FOREIGN PATENT DOCUMENTS

| | | | |
|---|---|---|---|
| 137219 | 7/1947 | Australia | 417/206 |
| 2236751 | 7/1972 | Germany | 417/206 |

*Primary Examiner*—Richard A. Bertsch
*Assistant Examiner*—Roland G. McAndrews, Jr.
*Attorney, Agent, or Firm*—Zarley, McKee, Thomte, Voorhees, & Sease

[57] ABSTRACT

A hydrostatic pump of the axial piston type having a significantly reduced overall length due to a special three point bearing arrangement for the main shaft (1) of the pump and the charge pump shaft (12). The improvement comprises a bearing assembly which consists of just three bearings (6, 14, 23) at separate locations for simultaneously supporting the coupled main shaft (1) and charge pump shaft (12). A first bearing 6 is located at the end of the main shaft (1) which is opposite that coupled to the charge pump shaft (12), a second bearing (14) is located at the end of the charge pump shaft (12) which is opposite to that coupled to the main shaft (1), and a third bearing (23) is located at the junction of the coupled shafts (1,12) to provide for their common support. The third bearing (23) can be a needle bearing or of the plain bushing type. The shafts (1,12) can be coupled by mating splines (17,22) and engage each other in a clearance fit (21).

8 Claims, 4 Drawing Sheets

HYDROSTATIC AXIAL PISTON PUMP WITH THREE BEARING ARRANGEMENT

This is a continuation of application Ser. No. 08/104,887 filed on Aug. 10, 1993, abandoned.

BACKGROUND OF THE INVENTION

The invention is related to a hydrostatic pump operating in a closed circuit, comprising an axial piston rotating kit and a charge pump.

Compared to the width and height, the overall length of hydrostatic components has become an increasingly important criteria in vehicle applications. For example, in small and medium sized wheel loaders the combustion engine, and thus the hydrostatic pumps mounted thereto in the power train, are often installed perpendicular to the long axis of the vehicle. In this configuration, convenient access for service is obtained. Because such a transverse engine assembly is often located behind the rear axle, it proves useful for counterbalancing other parts of the vehicle. But the length of the hydrostatic components which are attached to the engine can unacceptably increase the width of the vehicle. It is important that the length of the hydrostatic components be kept to a minimum.

Another reason for length reduction is the common practice of using tandem (double) or even triple pump designs in place of split gear boxes where single pumps would have to be individually mounted.

The primary objective of the present invention is to provide an axial piston pump having shortened overall length.

Another objective of the present invention is to simplify the assembly of the pump, especially by reducing the number of parts required.

Another objective of the present invention is to provide a pump and power train which are economical to manufacture.

Another objective of the present invention is to provide a pump and power train which are reliable.

These and other objectives will be apparent to one skilled in the art from the description which follows.

SUMMARY OF THE INVENTION

The present invention is a reduced length hydrostatic pump for a closed circuit hydrostatic transmission having an axial piston rotating kit in a housing. The kit includes a main shaft extending through the center of the kit, into an endcap and then a charge pump before being coupled with a charge pump shaft. The main shaft and charge pump shaft receive radial support for rotation at only three points using only three bearings.

A first bearing located in the housing supports the shaft near its forward end. A second bearing supports the charge pump shaft near its rearward end (the one not coupled to the main shaft). A third bearing is located in load bearing proximity with the area where the main shaft and charge pump shaft are coupled. The third bearing simultaneously supports both the rearward end of the main shaft and the forward end of the charge pump shaft.

This three bearing arrangement is possible whether the charge pump shaft is coupled and supported on the inner or outer diameter of the main shaft. The shafts can be coupled for torque transmission in a variety of ways including by mating splines.

DETAILED DESCRIPTION OF THE PREFERRED EMBODIMENT

Figure 1:
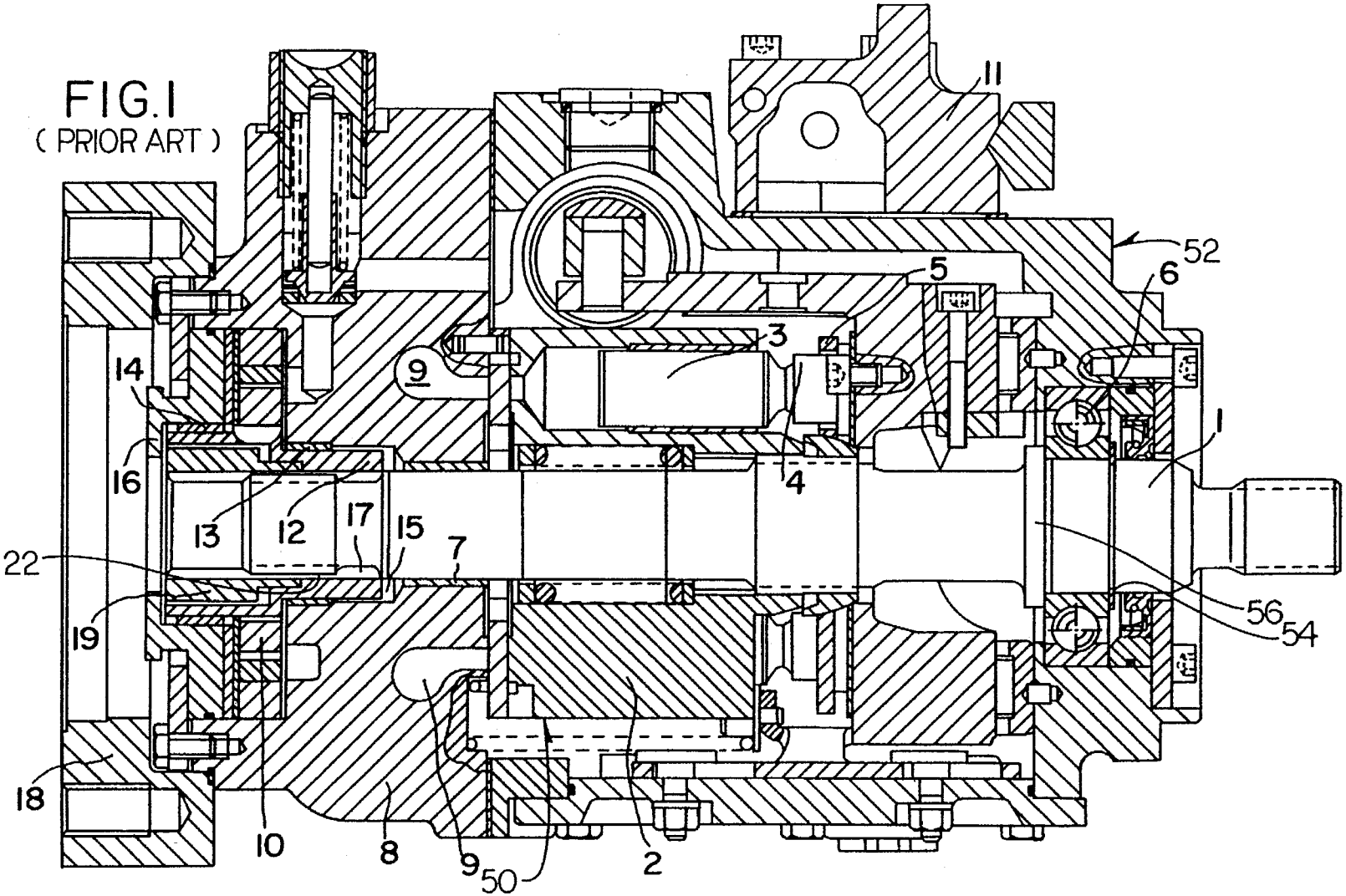
FIG. 1 (PRIOR ART)
FIG. 1 is a sectional view of an axial piston pump known in the art.
Figure 2:
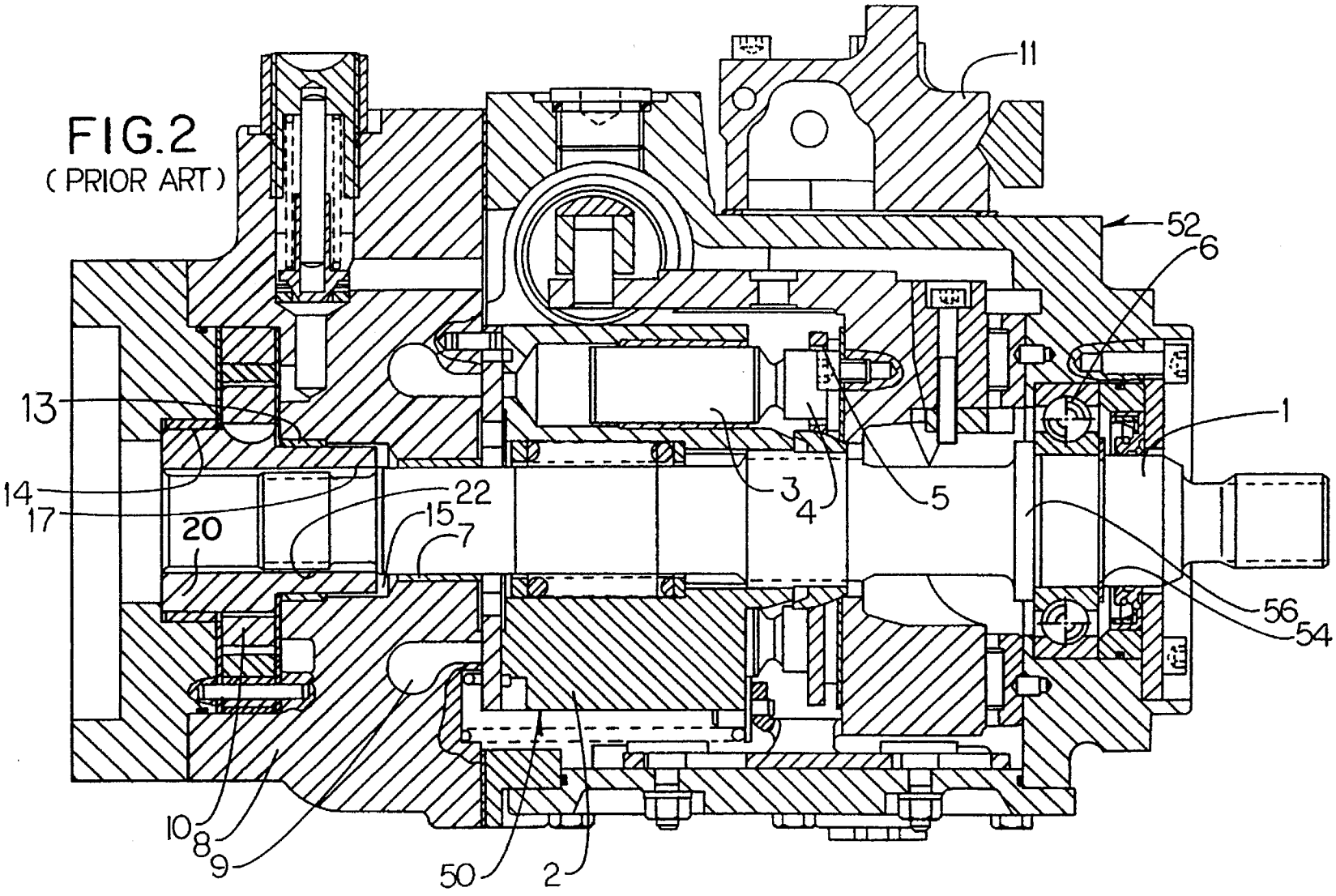
FIG. 2 (PRIOR ART)
FIG. 2 is a second sectional view of an axial piston pump known in the art.

FIGS. 1 and 2 present conventional concepts of variable axial piston pumps for closed circuits having an auxiliary pad for mounting a second pump or other devices.

In FIG. 1, the main shaft 1 receives rotary power from an engine (not shown) and drives the axial piston rotating kit. In addition to shaft 1, the kit 50 comprises a cylinder block 2, pistons 3, slippers 4 and a slipper retaining element 5. Shaft 1 is equipped with a bearing 6 of the ball or roller type in the front part of the pump housing 52. This bearing is essentially fixed on the shaft axially by retaining ring 54 and shoulder 56.

Another bearing 7 mounted on the opposite side of the cylinder block 2 is used as a movable bearing. Usually this movable bearing 7 is a polytetrafluoroethylene (PTFE) coated plain bearing, a so-called. PTFE DU-bushing. A needle bearing could be used according to FIG. 4. The movable bearing of the main shaft is located in the endcap 8, which connects the high pressure ports 9 of the cylinder block with system high pressure (working) ports. Main shaft 1 is shown here to be solid at the endcap end, but it can also be hollow and have an inner and outer diameter thereon.

A charge pressure pump 10, which is essential for closed circuits, charge check valves and pressure relief valves are integrated into the endcap. The charge pump 10 is normally of the gerotor or internal gear type. Its main task is to feed makeup fluid to the low pressure side of the system circuit and to provide fluid for the servo control system 11. The charge pump 10 has its own shaft 12, which is needed for centering and driving the charge pump gerotor or gear. Charge pump shaft 12 has an inner and outer diameter. In the radial direction, shaft 12 is supported by two plain bearings 13 and 14. In the axial direction, movement is restrained by a shoulder 15 on the main shaft 1 and a shoulder on the charge pump cover 16.

The torque between the main shaft and the charge pump shaft is transmitted by mating splines 22 and 17 respectively.

To provide for the mounting of a second pump to this first pump, a separate mounting pad 18 is attached to the endcap 8. A coupling shaft 19 couples the shaft of the first pump to the shaft of the second pump (not shown) so as to allow the effective transmission of rotary power thereto.

FIG. 2 shows a pump having shortened overall length. The reduction in length is achieved by eliminating the coupling shaft and driving the second pump directly with a different charge pump shaft 20. In both FIGS. 1 and 2, the main shaft and charge pump shaft are supported by four bearings.

Figure 3:
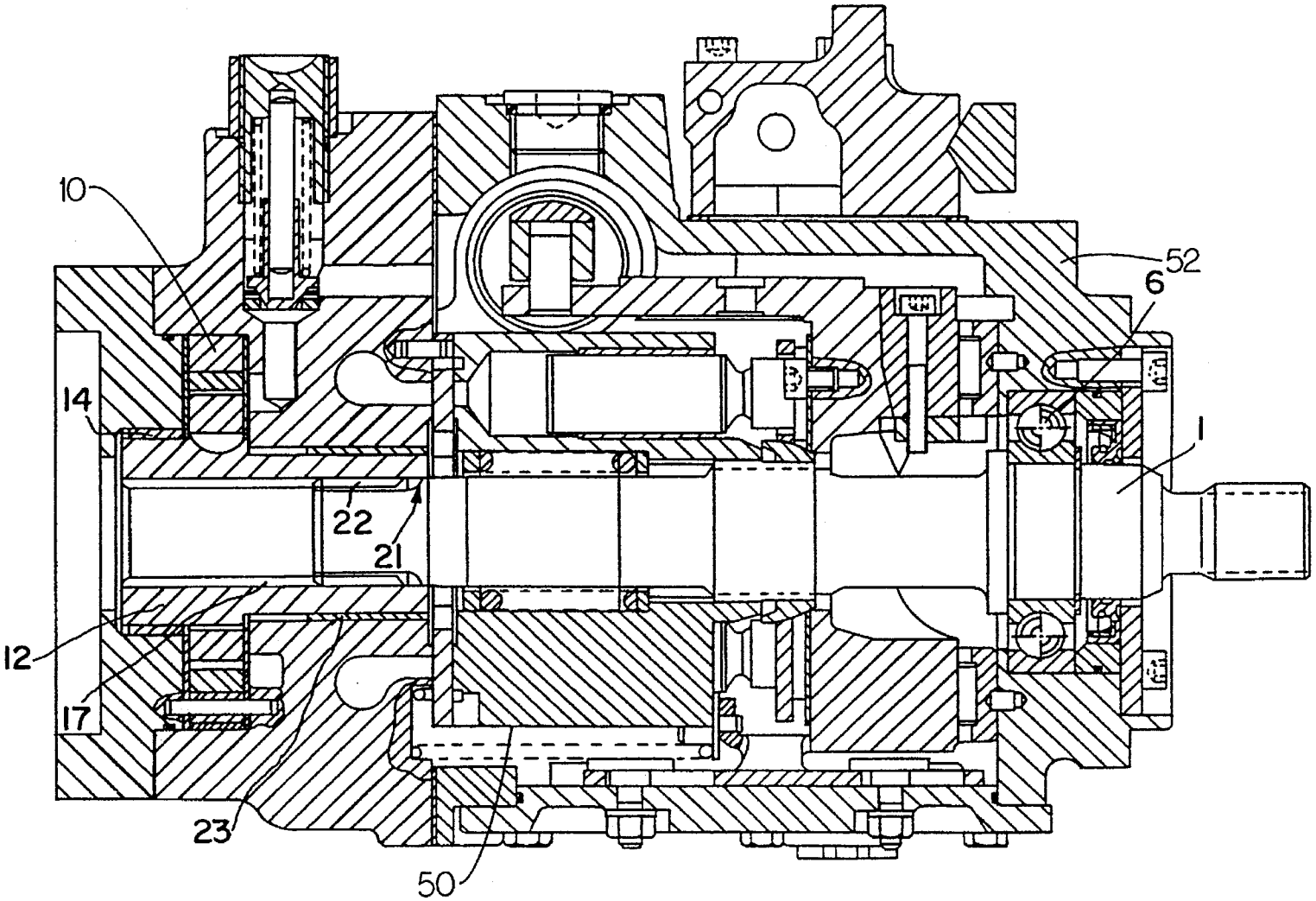
FIG. 3 is a sectional view of an axial piston pump according to the invention.
Figure 4:
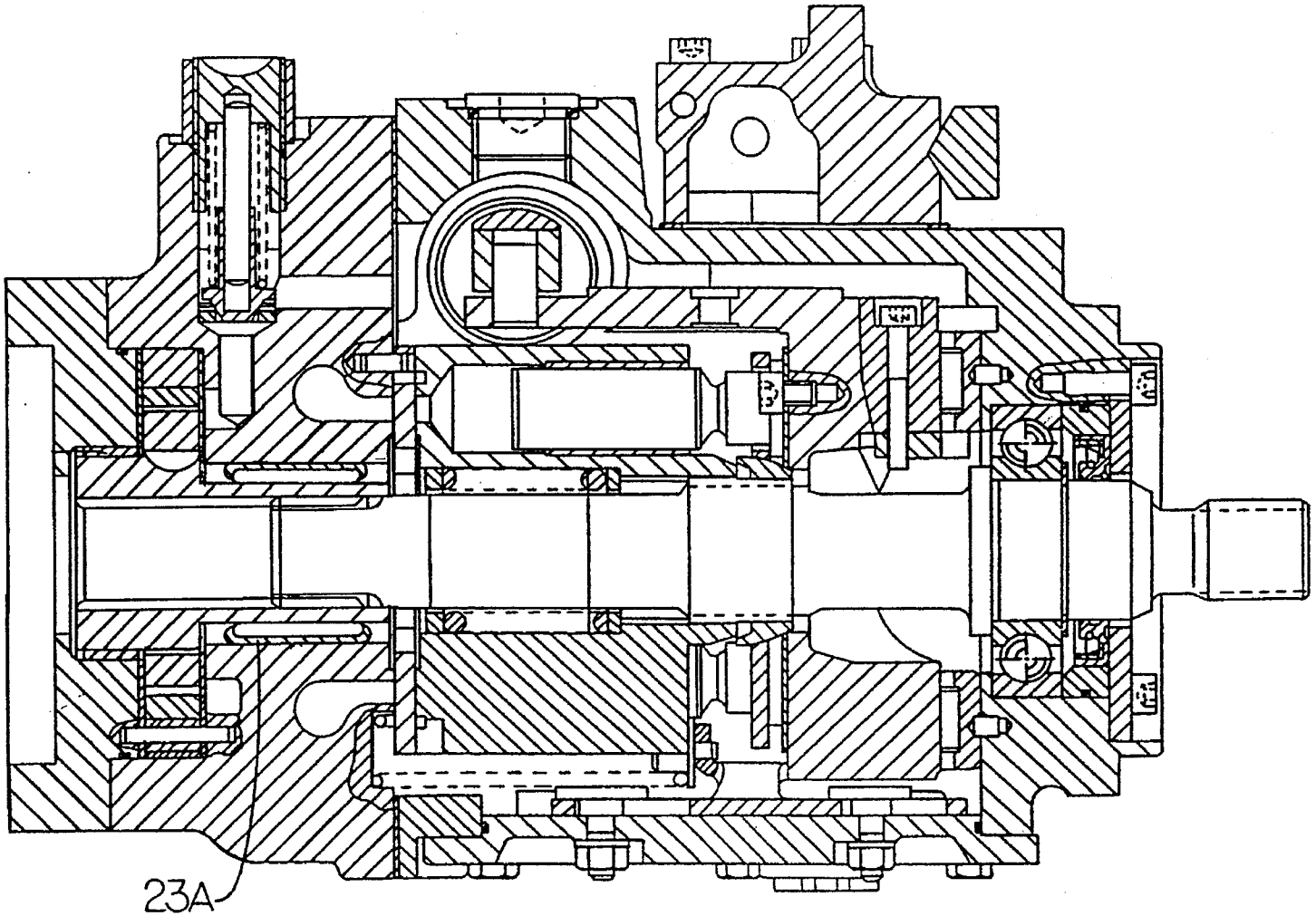
FIG. 4 is a sectional view of another axial piston pump according to the present invention wherein the third bearing is a needle bearing.

FIG. 3 shows how a significant reduction in the length of a pump is achieved with the present invention. Here, the plain bearing on the main shaft is eliminated. Radial guidance is provided by a clearance fit 21 of the pump shaft within the charge pump shaft 12. Again the torque is transmitted by mating splines 22 and 17. In radial direction at the area where the two shafts are coupled, the charge pump shaft 12 and main shaft 1 are supported by a single common plain bearing 23 (FIG. 3) or a needle bearing 23A (FIG. 4).

In contrast with the arrangements known in the art, only three bearings are necessary. No further means for radial support need be provided for the shafts. Besides saving the cost of a fourth bearing, the present invention eliminates an expensive precision bore in the endcap which was required to accommodate the bearing. The charge pump 10 can be positioned closer to cylinder block 2 because there are no longer two bearings which must be arranged end to end. The result is a significant reduction in the length of the pump and the power train in which it is utilized.

It is also contemplated that pumps equipped with SAE "B," SAE "C" or SAE "D" adapters providing through drive can be designed considerably shorter because the shaft of the charge pump extends deeper into the end cap due to the fact that the splines 22 on the main shaft and 17 on the charge pump shaft are closer to the cylinder block kit 50.

It can be seen from the above that the invention at least accomplishes its stated objectives.

I claim:

1. In an axial piston pump for a closed circuit hydrostatic transmission having a housing, a shaft assembly in the housing drivingly connected to an axial piston rotating kit and to a charge pump, the shaft assembly including a main shaft having opposite ends and a charge pump shaft having opposite ends, one of the charge pump shaft ends being coaxially coupled to an end of the main shaft, the main shaft being drivingly connected to the axial piston rotating kit and the charge pump shaft being drivingly connected to the charge pump, the improvement comprising:

a bearing arrangement having only three bearings operatively mounted on the housing for completely rotatably supporting the shaft assembly;

said bearing arrangement including of a first bearing mounted in the housing and located at an end of the main shaft remote from the charge pump shaft for supporting the shaft assembly for rotation in the housing, a second bearing operatively mounted on the housing and located at the end of the charge pump shaft remote from the main shaft for supporting the charge pump shaft for rotation, and a third bearing operatively mounted on the housing and aligned with the coaxially coupled ends of the charge pump shaft and main shaft such that the charge pump shaft and main shaft are simultaneously supported for rotation.

2. The axial piston pump of claim 1 wherein said third bearing which is common to both of said shafts is a plain bushing bearing.

3. The axial piston pump of claim 1 wherein said third bearing which is common to both of said shafts is a needle bearing.

4. The improved axial piston pump of claim 1 wherein the charge pump includes a gerotor set driven by the charge pump shaft.

5. The improved axial piston pump of claim 1 wherein mating splines are provided on the charge pump shaft for the transmission of torque when said main shaft and charge pump shaft are coupled together.

6. The improved axial piston pump of claim 5 wherein the third bearing has opposite ends and a middle located approximately midway between the ends and the spline of the main shaft has an axial center that is generally aligned with the middle of the third bearing.

7. The improved axial piston pump of claim 1 wherein the charge pump shaft is hollow, having an inner and an outer diameter, and the main shaft engages the inner diameter of the charge pump shaft and the third bearing engages the outer diameter of the charge pump shaft.

8. The axial piston pump of claim 7 wherein a clearance fit is provided between said main shaft and said charge pump shaft.

* * * * *

UNITED STATES PATENT AND TRADEMARK OFFICE

CERTIFICATE OF CORRECTION

PATENT NO. : 5,501,578

DATED : March 26, 1996

INVENTOR(S) : Eckhard Skirde

It is certified that error appears in the above-indentified patent and that said Letters Patent is hereby corrected as shown below: Title page :

Item [54] on the title and col. 1, lines 1-2 should read

HYDROSTATICA AXIAL PISTON PUMP

Signed and Sealed this

Eighteenth Day of June, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,501,578

DATED : March 26, 1996

INVENTOR(S) : Eckhard Skirde

It is certified that error appears in the above-indentified patent and that said Letters Patent is hereby corrected as shown below:

On title page, item [54], and col. 1, lines 1-2 should read:
--HYDROSTATIC AXIAL PISTON PUMP WITH THREE BEARING ARRANGEMENT--

This certificate supersedes Certificate of Correction issued June 18, 1996.

Signed and Sealed this

Twenty-seventh Day of August, 1996

*Attest:*

Bruce Lehman

BRUCE LEHMAN

*Attesting Officer*

*Commissioner of Patents and Trademarks*